US010874932B1

(12) United States Patent
Kane

(10) Patent No.: US 10,874,932 B1
(45) Date of Patent: Dec. 29, 2020

(54) BATTING TEE TARGETING APPARATUS

(71) Applicant: Balance Bike, LLC, Asbury, NJ (US)

(72) Inventor: Michael S. Kane, Asbury, NJ (US)

(73) Assignee: Balance Bike, LLC, Asbury, NJ (US)

( * ) Notice: Subject to any disclaimer, the term of this patent is extended or adjusted under 35 U.S.C. 154(b) by 0 days.

(21) Appl. No.: 16/583,897

(22) Filed: Sep. 26, 2019

(51) Int. Cl.
*A63B 69/00* (2006.01)
*A63B 71/06* (2006.01)
*A63B 102/18* (2015.01)

(52) U.S. Cl.
CPC ..... *A63B 71/0622* (2013.01); *A63B 69/0002* (2013.01); *A63B 69/0075* (2013.01); *A63B 2069/0008* (2013.01); *A63B 2071/0694* (2013.01); *A63B 2102/182* (2015.10); *A63B 2220/16* (2013.01); *A63B 2225/09* (2013.01); *A63B 2225/74* (2020.08)

(58) Field of Classification Search
CPC ..... A63B 71/0622; A63B 69/0002; A63B 69/0075; A63B 2102/182; A63B 2069/0008; A63B 2071/0694; A63B 2207/02; A63B 2220/16; A63B 2225/09; A63B 69/3614; A63B 63/06
USPC ..... 473/422, 417, 431, 451, 453, 461, 473/220–222, 150, 140, 145; 463/1–4, 463/7–8, 36–38, 45–57; 353/42, 43
See application file for complete search history.

(56) References Cited

U.S. PATENT DOCUMENTS 4,583,733 A 4/1986 Ito et al.
4,997,189 A * 3/1991 Perkins ..... A63B 69/3614 473/221
5,046,988 A 9/1991 E'nama
5,213,331 A 5/1993 Avanzini
5,330,188 A * 7/1994 Reimers ..... A63B 69/3614 473/151
5,343,376 A * 8/1994 Huang ..... G02B 27/20 362/187
5,365,427 A * 11/1994 Soignet ..... A63B 24/0021 340/323 R
5,388,831 A 2/1995 Quadri et al.
5,419,549 A * 5/1995 Galloway ..... A63B 47/002 473/431
5,450,148 A * 9/1995 Shu ..... G02B 27/20 353/42
5,465,972 A * 11/1995 Cornett ..... A63B 69/3614 473/220
5,683,302 A 11/1997 Harrell et al.
5,711,726 A 1/1998 Powers
5,818,036 A 10/1998 Daly
6,007,436 A * 12/1999 Mark ..... A63B 69/3667 473/220

(Continued)

*Primary Examiner* — Mitra Aryanpour
(74) *Attorney, Agent, or Firm* — Dunlap Codding, P.C.

(57) ABSTRACT

A batting practice tee has a tee portion and a targeting apparatus in association with the tee portion. The tee portion has a support structure and a ball holder. The support structure has a base end and a distal end. The ball holder is connected to distal end of the support structure and has a ball receiving opening. The targeting apparatus has a light transmitter and an angle indicator in association with the light transmitter. The light transmitter is positioned adjacent the ball holder and produces a light stream to project a target onto a surface. The angle indicator provides a human-perceivable indication of an angle of the light relative to a horizontal plane.

9 Claims, 4 Drawing Sheets

(56) References Cited

U.S. PATENT DOCUMENTS 6,304,665 B1 * 10/2001 Cavallaro ..... A63B 24/0021 382/106
6,695,723 B2 * 2/2004 Leal ..... A63B 47/002 473/417
6,769,992 B1 * 8/2004 Domulevicz ..... A63D 15/006 473/2
7,536,033 B2 * 5/2009 Kirby ..... A63B 24/0003 382/107
7,892,116 B2 * 2/2011 Kellogg ..... A63B 69/0002 473/422
8,678,955 B2 * 3/2014 McKendrick ..... A63B 69/0075 473/418
8,852,032 B1 * 10/2014 Barnes ..... A63B 69/00 473/453
9,375,622 B2 6/2016 Bond
9,700,777 B2 * 7/2017 Dilz, Jr. ..... A63B 69/0002 473/417
9,833,675 B2 12/2017 Bynum
10,071,281 B1 * 9/2018 Loduca ..... A63B 69/0002 473/417
10,071,296 B2 * 9/2018 Dilz, Jr. ..... A63B 24/0021 473/417
2006/0058122 A1 3/2006 Cox
2007/0021242 A1 * 1/2007 Krickler ..... A63B 24/0021 473/451
2007/0078018 A1 * 4/2007 Kellogg ..... A63B 63/06 473/151
2008/0085787 A1 4/2008 Molley et al.
2008/0090670 A1 * 4/2008 Liu ..... A63D 15/006 473/2
2008/0182686 A1 * 7/2008 Kellogg ..... A63B 69/0002 473/451
2009/0143156 A1 * 6/2009 Schulze ..... A63D 15/105 473/46
2013/0143695 A1 * 6/2013 Hart ..... A63B 69/0002 473/458
2018/0169493 A1 6/2018 Gardner et al.

* cited by examiner

BATTING TEE TARGETING APPARATUS

BACKGROUND

Sports such as baseball and softball involve hitting a ball with a bat. Being proficient at hitting a baseball or a softball requires practice. Many types of training devices have been developed over the years to help players become more skilled at hitting. The most common practice device used for hitting practice is a hitting tee of the type with a stationary stand on which the baseball or softball sits. The height of the hitting tee, and thus the ball when it is on the hitting tee, is usually adjustable to allow the user to tailor the apparatus for his or her body height or for the particular level of swing he or she wishes to make within the strike zone for that batter.

In use, the batter simply assumes a stance in relation to a ball placed on the tee and swings the bat at the ball on the tee. While ball movement is entirely eliminated, the swing action sufficiently replicates the swing mechanics the batter would use in swinging at a pitched ball that the muscle and neurological training is considered highly effective.

Besides the batting tee, some players use technology to improve the mechanics of their swing. For example, some devices use high-speed cameras to calculate the batting angle and exit velocity. Other devices are setup so a batter can swing into or through the device and the device then provides the batter with data readouts. However, technology which can calculate exit velocity and hitting angle is costly and frequently subject to error. Additionally, prior art does not provide the batter with the advantages of real-life training using a batting tee, batting angle information, and a target at which the batter can aim to develop muscle memory.

Further, accurate hitting demands precise application of distance and direction factors. Distance problems generally are easily seen, and can be corrected; however, alignment factors are less easy to visualize. There is a need for a device which allows the batter to visualize the correct target direction and perform an accurate check of the swing direction, thus making it possible to repeat on the field. Batters need to be confident of their initial aim at the target and their execution during play. Enhanced practice can achieve that goal.

To this end, a need exists for a device which provides a batter the ability to practice hitting a ball at the desired hitting angle and the ability to develop muscle memory using a target. It is to such an apparatus that the inventive concepts disclosed herein are directed.

DETAILED DESCRIPTION OF EXEMPLARY EMBODIMENTS

Figure 1:
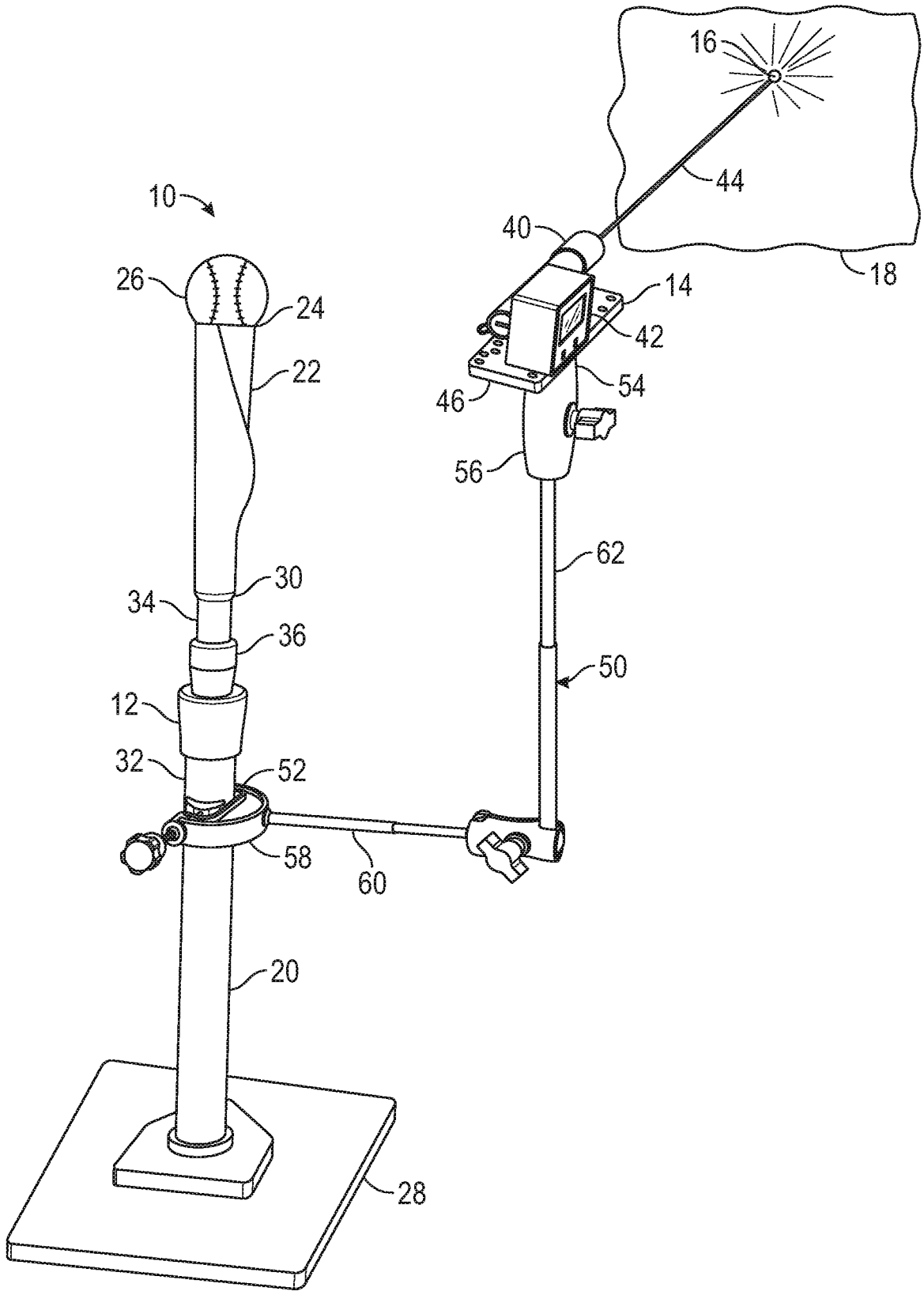
FIG. 1 is a rear perspective view of a batting practice tee constructed in accordance with the inventive concepts disclosed herein with a baseball supported thereby and projecting a target on a surface.

The inventive concepts disclosed are generally directed to a batting practice tee that includes a tee portion and a targeting apparatus in association with the tee portion. The tee portion has a support structure and a ball holder. The support structure has a base end and a distal end. The ball holder is connected to the distal end of the support structure and has a ball receiving opening. The targeting apparatus has a light transmitter and an angle indicator in association with the light transmitter. The light transmitter is positioned adjacent to the ball holder and produces a light stream to project a target on a surface. The angle indicator provides a human-perceivable indication of an angle of the light stream relative to a horizontal plane.

Additionally, the inventive concepts disclosed are directed to a method of forming a target for practice hitting including obtaining a support structure, a ball holder, and a light transmitter, positioning the light transmitter, activating the light transmitter, and adjusting the light transmitter. The support structure has a base end and a distal end. The ball holder is connected to the distal end of the support structure and has a ball receiving opening. The light transmitter is positioned adjacent the ball holder. When activated, the light transmitter produces a light stream. The light transmitter is adjusted relative to the ball holder to cause the light stream to project a target on a surface in a selected direction at a selected launch angle.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
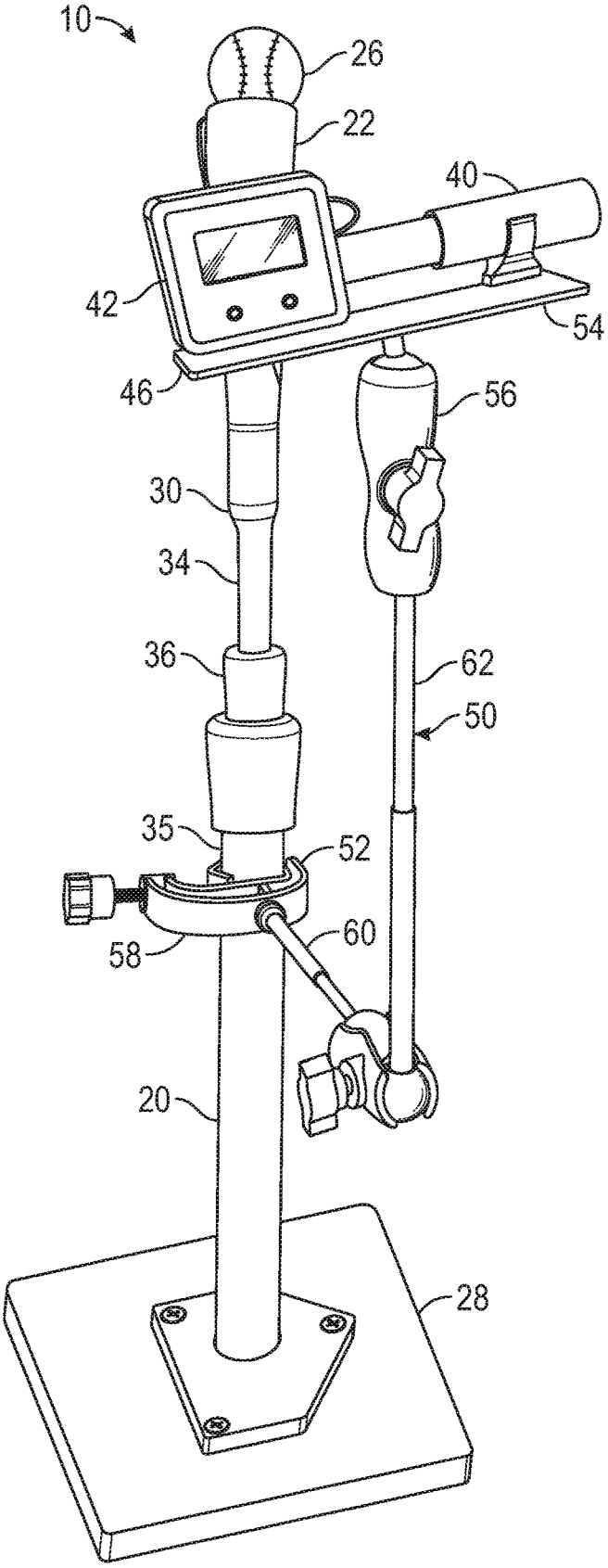
FIG. 2 is a side perspective view of the batting practice tee of FIG. 1.

Referring now to the drawings, and in particular to FIGS. 1 and 2, shown therein is an exemplary embodiment of a batting practice tee 10 constructed in accordance with the inventive concepts disclosed herein. Broadly, the batting practice tee 10 includes a tee portion 12 and a targeting apparatus 14 positionable in association with the tee portion 12 to project a target 16 on a surface 18, such as a wall or screen forming a portion of a batting cage.

In one embodiment, the tee portion 12 may include a support structure 20 and a ball holder 22 having a ball receiving space 24 for supporting a ball 26, such as a baseball or softball. The support structure 20 may include a base end 28 and a distal end 30. The support structure 20 may be one piece or include a plurality of telescoping sections, such as a first telescoping section 32 and a second telescoping section 34, to permit the position of the distal end 30 of the support structure 20 relative to the base end 28 to be selectively adjusted. The first and second telescoping sections 32 and 34 may be releasably secured relative to one another in any suitable manner, such as with a coupling 36.

The support structure 20 may be formed in a variety of shapes and may be made from a variety of materials including, but not limited to, metal, plastic, or a combination thereof, so the support structure 20 is rigid, impact resistant, light weight, and corrosive resistant. Also, while the support structure 20 is shown as being cylindrical in shape, it is understood that the support structure 20 may be made of a variety of other shapes or configurations including but not limited to square, oval and rectangular.

The base end 28 is positioned at a lower end of the support structure to provide stability to the batting practice tee 10 and thus to prevent the batting practice tee 10 from tipping over when in use. In one embodiment, the base end 28 may be a weighted member releasably connected to the support structure. However, it should be appreciated that the base end 28 may be in many forms if the base end 28 provides stability to the practice hitting tee 10. For example, the base end 28 may be an H-shaped structure or a structure with a cavity to permit the base end to be weighted with sand or water. Also, the base end 28 may include a plurality of legs to form a stand, similar to a tripod. In another embodiment, the base end 28 may be in the form of a spike that may be inserted into the ground.

The ball holder 22 is connected to the distal end 30 of the support structure 20. In use, a ball, such as the ball 26, is positioned in the ball receiving opening 24 of the ball holder 22 so the ball 26 is supported by the ball holder 22. The hitter strikes the ball 26 with a bat dislodging the ball 26 from the ball holder 22. The ball holder 22 may be constructed in a variety of ways. In one embodiment, the ball holder 22 may be a solid conical piece. In another embodiment, the ball holder 22 may be formed on a flexible sheet, as described in U.S. Pat. No. 6,358,163, which is hereby incorporated herein by reference. Other examples of a suitable ball holder are described in U.S. Pat. Nos. 9,452,336 and 9,352,204; the contents of each being hereby incorporated herein by reference.

In one embodiment, the targeting apparatus 14 may include a light transmitter 40 and an angle indicator 42 in association with the light transmitter 40. The light transmitter 40 produces a light stream 44 projecting the target 16 onto the surface 18. Users will hit the ball 26 at a launch angle relative to a horizontal plane in an attempt to hit the target 16. The light transmitter 40 may be a light emitting device such as a laser pointer (shown in FIGS. 1-3) or a flashlight (shown in FIG. 4). It will be appreciated that the light stream 44 may take several different forms, such as a beam, a rectangular shape, or a conical shape. Different light streams may produce different shapes of targets on the surface, for example, a dot, square, or circle. Any suitable light source may be utilized to provide the light stream 44 and the target 16, including without limitation, light emitting diodes (LEDs), lasers, light bulbs, compact fluorescent light (CFL) bulbs, incandescent light bulbs, halogen light bulbs, and/or fluorescent light bulbs.

The angle indicator 42 provides a human-perceivable indication of an angle of the light stream relative to the horizontal plane. The angle indicator may be a level, such as level 42. The angle indicator 42 and the light transmitter 40 may be connected to a platform 46 connected to the support portion of the targeting apparatus discussed below. In one embodiment, the human-perceivable indication of the angle of the light stream is visual, such as a digital numerical representation (FIGS. 1-3) or a representation involving a gravitational system that moves an object among markings corresponding to the angle relative to the horizontal place, such as a bubble level (FIG. 4). However, it will be appreciated that the human-perceivable indication may take another form, such as auditory.

As previously stated, users attempt to dislodge the ball 26 from the ball holder 22 at the launch angle relative to the horizontal plane in an attempt to hit the target 16. If the user is able to hit the target 16, the angle of the light stream 44 will be approximately equivalent to the launch angle of the ball 26. If the ball 26 strikes above the target 16, the launch angle is greater than the angle of the light stream 44. Conversely, if the ball 26 strikes beneath the target 16, the angle is likely less than the angle of the light stream 44.

In one embodiment, the targeting apparatus 14 may have a support structure 50. The support structure 50 provides stability for the targeting apparatus 14 and supports the light transmitter 40 and the angle indicator 42 relative to the ball holder 22 of the tee portion 12. As shown in FIGS. 1 and 2, the support structure 50 of the targeting apparatus 14 has a first end 52 and a second end 54. The first end 52 is connected to the support structure 20 of the tee portion 12, and the second end 54 is connected to the light transmitter 40. The second end 54 of the support structure 50 may include a platform 46 that supports the light transmitter 40. The connection of the second end 54 of the support structure 50 of the targeting apparatus 14 to the platform 46 supporting the light transmitter 40 may be so the light transmitter 40 and the angle indicator 42 are adjustable relative to the tee portion 12, such as by a coupling 56. In other embodiments, the light transmitter 40 may be connected to the angle indicator 42, and at least one of the angle indicator 42 and the light transmitter 40 is connected to the support structure 50 of the targeting apparatus 14. The light transmitter 40 and the angle indicator 42 are adjustable relative to the ball holder 22 so users can adjust the launch angle and the horizontal direction of the target 16.

The connection of the first end 52 of the support structure 50 of the targeting apparatus 14 to the support structure 20 of the tee portion 12 may be so the targeting apparatus 14 is adjustable relative to the tee portion 12, such as by fastener 58. In one embodiment, the adjustability of the targeting apparatus 14 accommodates left-handed and right-handed users. It will be appreciated that many fasters exist, such as various clamps and couplings, that might serve this function, and the inventive concepts disclosed herein are not limited to the disclosed fastener.

The support structure 50 of the targeting apparatus 14 may be one piece or include a plurality of telescoping sections, such as a first telescoping 60 section and a second telescoping section 62, to permit the position of the second end 54 of the support structure 50 relative to the ball holder 22 to be selectively adjusted. The first and second telescoping sections 60 and 62 may be releasably secured and adjustable relative to one another in any suitable manner, such as with a coupling (not shown).

In use, a ball, such as the ball 26, is positioned in the ball receiving opening 24 of the ball holder 22, as illustrated in FIGS. 1 and 2. The light transmitter 40 is positioned adjacent the ball holder 22 and the light transmitter 40 is activated to produce the light stream 44. The light transmitter 40 is adjusted relative to the ball holder 22 to cause the light stream 40 to project the target 16 on the surface 18 in a selected direction at a selected launch angle. The hitter then strikes the ball 26 with a bat with the intention of hitting the ball 26 at the target 16.

Figure 3:
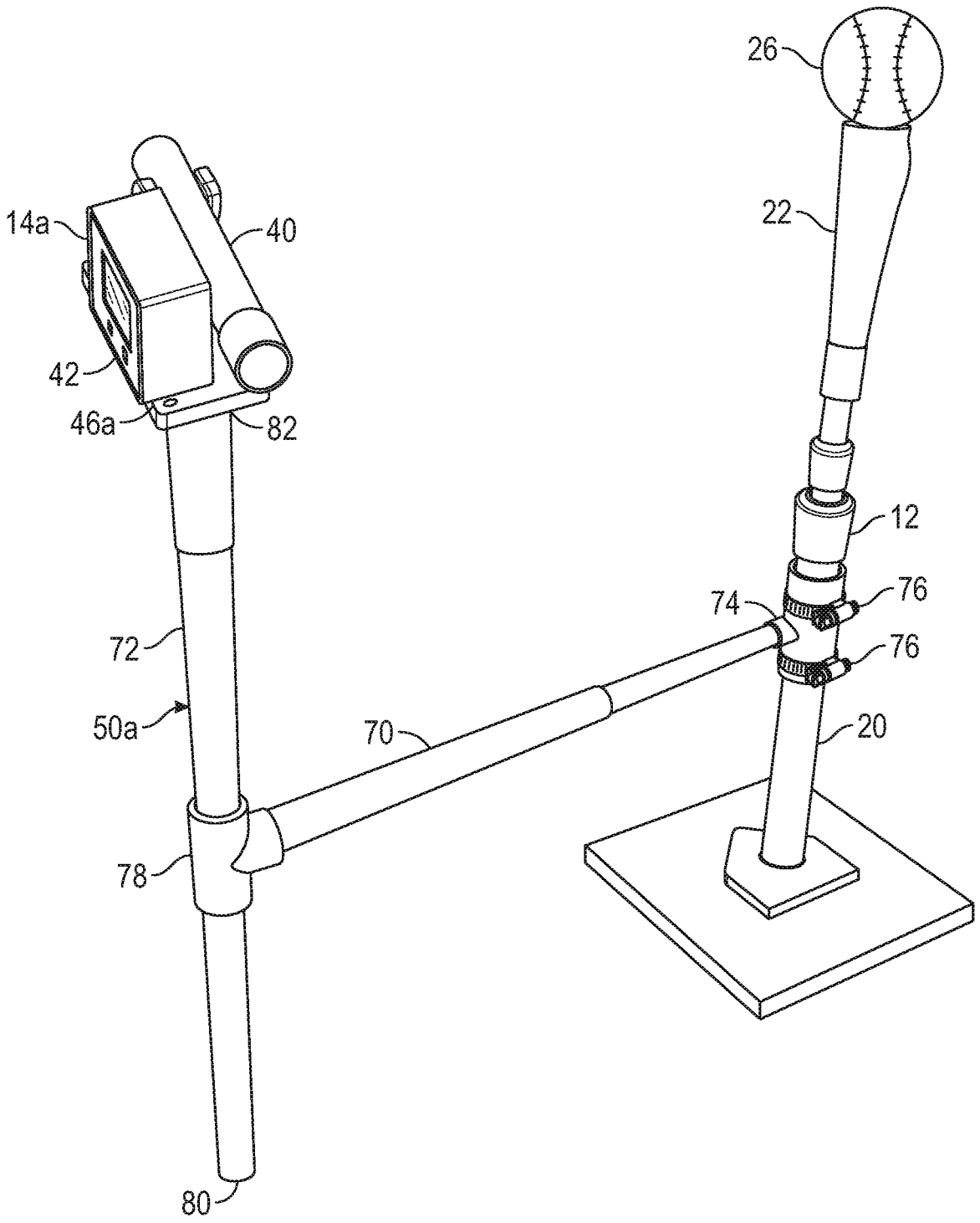
FIG. 3 is a perspective view of another embodiment of a batting practice tee constructed in accordance with the inventive concepts disclosed herein.
Figure 4:
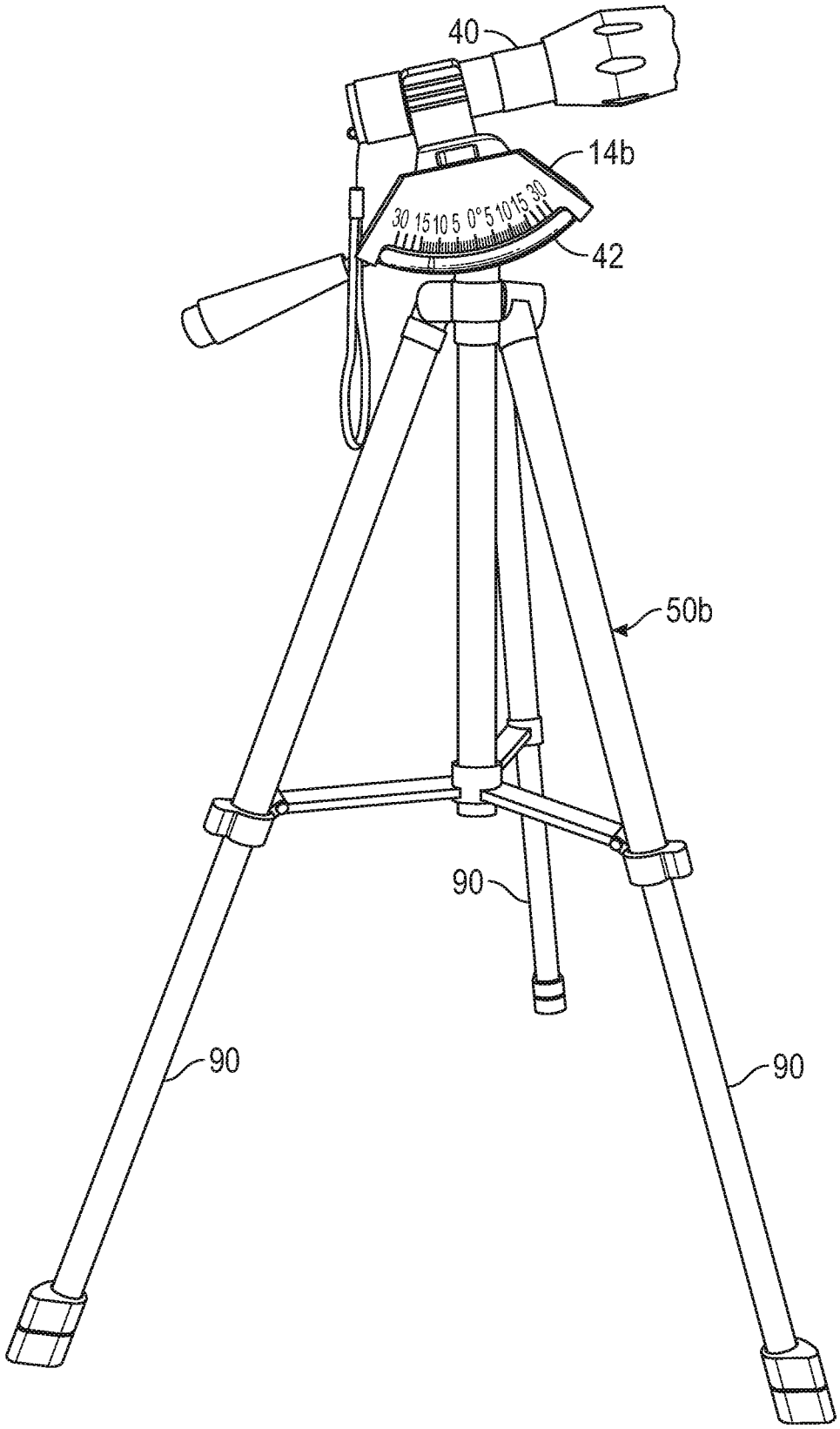
FIG. 4 is a side view of yet another targeting apparatus constructed in accordance with the inventive concepts disclosed herein.

Referring now to FIG. 3, another embodiment of a targeting apparatus 14*a* is illustrated. The targeting apparatus 14*a* includes the light transmitter 40, the angle indicator 42, and a support structure 50*a*. The support structure 50*a* includes a horizontal support portion 70 and a vertical support portion 72. The horizontal support portion 70 has a first end 74 connected to the support structure 20 of the tee portion 12 and a second end 76 connected to the vertical support portion 72. The connection of the first end 74 of the horizontal support portion 70 to the support structure 20 of the tee portion 12 may be so the targeting apparatus 14*a* is adjustable to accommodate left-handed and right-handed users. For example, the connection may be by at least one adjustable clamp, such as clamps 76.

The connection of the horizontal support portion 70 to the vertical support portion 72 may be so the horizontal support portion 70 and the vertical support portion 72 are perpendicular, such as T-shaped connection 78. The vertical support portion 72 has a first end 80 engageable with a horizontal surface or a ground surface and a second end 82 connected to the light transmitter 40. In one embodiment, the second end 82 has a platform 46*a* on which the light transmitter 40 is supported. The vertical support portion 72 may be formed of multiple telescoping sections so the light transmitter 40 and the angle indicator 42 are adjustable relative to the tee portion 12.

Referring now to FIG. 4, another embodiment of a targeting apparatus 14*b* is illustrated. The targeting apparatus 14*b* includes the light transmitter 40, the angle indicator 42, and a support structure 50*b*. The support structure 50*b* may include a plurality of legs 90 forming a stand, similar to a tripod, or be in the form of a spike that may be inserted into the ground support. The support structure 50*b* of the targeting apparatus 14*b* supports the light transmitter 40 and the angle indicator 42 adjacent to, but separate from, the ball holder 22 so the light transmitter 40 may project the target 16 on the surface 18 and the angle indicator 42 may provide the human-perceivable indication of the angle of the light stream 44 relative to the horizontal plane. It will be appreciated that the support structure 50*b* of the targeting apparatus 14*b* is not limited to the support structure shown in FIG. 4. For example, in other embodiments, the support structure 50*b* may be an elevated surface or an attachment mechanism engageable with an adjacent surface, such as a wall or ceiling.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and as defined in the appended claims.

What is claimed is:

1. A batting practice tee, comprising:
a tee portion, comprising:
a support structure having a base end and a distal end; and
a ball holder connected to the distal end of the support structure and having a ball receiving opening; and
a targeting apparatus in association with the tee portion, comprising:
a light transmitter positioned substantially level with the ball holder, the light transmitter producing a light stream to project a target on a surface; and
an angle indicator in association with the light transmitter providing a human-perceivable indication of an angle of the light stream relative to a horizontal plane,
wherein the angle of the light stream is adjustable to a selected angle confirmed by the angle indicator and representing a selected launch angle of a ball from the ball holder.

2. The batting practice tee of claim 1, wherein the targeting apparatus is connected to the support structure of the tee portion.

3. The batting practice tee of claim 1, wherein the targeting apparatus has a support structure connected to the support structure of the tee portion.

4. The batting practice tee of claim 3, wherein the support structure has a horizontal support portion and a vertical support portion.

5. The batting practice tee of claim 4, wherein the vertical support portion has an upper end and a lower end, the lower end engageable with a ground surface.

6. The batting practice tee of claim 1, wherein the light transmitter is adjustable.

7. The batting practice tee of claim 1, wherein the angle indicator is adjustable.

8. A batting practice tee, comprising:
a tee portion, comprising:
a support structure having a base end and a distal end; and
a ball holder connected to the distal end of the support structure and having a ball receiving opening; and
a targeting apparatus in association with the tee portion, comprising:
a light transmitter positioned adjacent the ball holder, the light transmitter producing a light stream to project a target on a surface; and an angle indicator in association with the light transmitter providing a human-perceivable indication of an angle of the light stream relative to a horizontal plane, wherein the targeting apparatus has a support structure connected to the support structure of the tee portion, and wherein the support structure of the targeting apparatus has a first end and a second end, the first end being attached to the support structure of the tee portion and the second end being connected to at least one of the light transmitter and the angle indicator.

9. A batting practice tee, comprising:

a tee portion, comprising:

a support structure having a base end and a distal end; and a ball holder connected to the distal end of the support structure and having a ball receiving opening; and a targeting apparatus in association with the tee portion, comprising:

a light transmitter positioned adjacent the ball holder, the light transmitter producing a light stream to project a target on a surface; and an angle indicator in association with the light transmitter providing a human-perceivable indication of an angle of the light stream relative to a horizontal plane, wherein the targeting apparatus has a support structure connected to the support structure of the tee portion, wherein the support structure has a horizontal support portion and a vertical support portion, and wherein at least one of the horizontal support portion and the vertical support portion is telescoping.

* * * * *